12/25/84 XR 4,489,984 SR

United States Patent [19]
Savins

[11] Patent Number: 4,489,984
[45] Date of Patent: Dec. 25, 1984

[54] IN-SITU URANIUM LEACHING PROCESS

[75] Inventor: Joseph G. Savins, Dallas, Tex.

[73] Assignee: Mobil Oil Corporation, New York, N.Y.

[21] Appl. No.: 370,704

[22] Filed: Apr. 22, 1982

[51] Int. Cl.[3] ..... E21B 43/28; E21C 41/14
[52] U.S. Cl. ..... 299/5; 166/273
[58] Field of Search ..... 299/4, 5; 166/273

[56] References Cited

U.S. PATENT DOCUMENTS 3,309,140 3/1967 Gardner et al. ..... 299/4
4,346,936 8/1982 Yan ..... 299/4
4,386,806 6/1983 Axen et al. ..... 299/5

*Primary Examiner*—Ernest R. Purser
*Attorney, Agent, or Firm*—A. J. McKillop; J. F. Powers, Jr.; M. G. Gilman

[57] ABSTRACT

The present invention provides an improved process for the in-situ recovery of mineral values, particularly uranium, from subterranean deposits that exhibit heterogeneous permeabilities in the formation zones. Aqueous solutions of thickening agents or viscosity building agents are utilized to control the mobility of the leaching solutions as they traverse the subterranean formation to solubilize the mineral values therein.

34 Claims, No Drawings

IN-SITU URANIUM LEACHING PROCESS

FIELD OF THE INVENTION

The present invention relates to a method for improving the recovery of mineral values such as uranium from subterranean ore bodies subjected to in-situ leaching by controlling the flow behavior of the leaching solution. More specifically, the present invention relates to an improved process for recovering mineral values such as uranium from a subterranean formation wherein improved sweep efficiency is provided through the use of mobility control agents.

BACKGROUND OF THE INVENTION

Conventionally, in in-situ solution-mining processes, the leaching solution is brought into contact with the subterranean deposit through a suitable injection system. The leaching solution or lixiviant may be an alkaline or acidic medium which solubilizes the mineral values as it traverses the ore body. Conventionally, the mineral values in an ore body are subjected to an oxidation step in order to convert the mineral values to a soluble form. For example, the tetravalent uranium must be oxidized to its soluble hexavalent form for leaching. The pregnant lixiviant is then withdrawn from the ore body through a suitable production system and treated to recover mineral values therefrom by suitable techniques such as solvent extraction, direct precipitation or by absorption and elution employing an ion exchange resin. The above method and modifications thereof work most efficiently when a fairly uniform formation is the subject of the leaching process. All too often, however, and in fact in the majority of cases, the formations are not uniform as to both porosity and permeability. In some zones, the strata are sufficiently heterogeneous as to severely alter flow patterns of the leaching fluids. Leaching fluids follow the higher permeability streaks thus by-passing portions of the ore body which results in loss of recoverable mineral values due to the lack of contact by leaching fluids. For example, in many uranium reservoirs, 30 to 50 wt.% or more of uranium values may not be recoverable via in-situ leaching because of channelling of leachate through the high permeability zones.

In secondary and tertiary oil recovery processes, the problem of channelling and fingering has also been recognized. Various methods utilizing polymeric material as viscosity builders or solution thickneners have been used as indicated by U.S. Pat. No. 3,434,542 to Dotson et al, U.S. Pat. No. 3,888,308 to Gale et al, U.S. Pat. No. 4,129,182 to Dabbous, U.S. Pat. No. 3,530,938 to Cooper, U.S. Pat. No. 4,066,126 To Waite el al, U.S. Pat. Nos. 3,292,698 and 4,042,030 to Savins et al, and U.S. Pat. No. 4,018,281 to Chang. The polymeric thickener or viscosity builder is normally utilized in either a water bank or a surfactant bank injected into the formation to drive the oil to a production system.

However, such polymeric material as utilized in secondary and tertiary oil recovery degrades and loses it's viscosity building effects when subjected to oxidants. As stated above, oxidants are essential to the in-situ recovery of mineral values such as uranium.

Accordingly, the present invention provides a new method wherein mobility control methods, utilizing polymeric material as thickeners or viscosity builders, are applied to the in-situ recovery of mineral values even when an oxidation step is necessary.

SUMMARY OF THE INVENTION

Accordingly, the present invention provides an improved process for the in-situ recovery of mineral values, particularly uranium, from subterranean deposits that exhibit heterogeneous permeabilities in the formation zones. The formation is penetrated by suitable injection and production systems. An oxidant is injected into the formation to oxidize the mineral values therein to their soluble forms. After the desired degree of oxidation is achieved, an aqueous leaching solution which contains a leaching agent and is substantially free of oxidant is injected into the formation to solubilize the mineral values therein. The leaching solution is displaced through the subterranean formation by means of a mobility control aqueous solution which contains a sufficient amount of thickening agent to give it a greater viscosity than the leaching solution. In another aspect of the invention, an aqueous solution containing a thickening agent is injected into the formation, after oxidation but prior to the injection of the leaching solution, in order to plug the higher permeability zones thus preventing the channelling of the leaching fluids. This alternate process could be preceeded by a conventional leaching process to recover the mineral values from the higher permeability zones. Furthermore, a thickening agent, that exhibits an increase in viscosity with increasing shear rate, may be added to the leaching solution to give it better sweep efficiency. The above processes substantially reduce the fingering and channeling of the leaching solution thus increasing the mineral recovery not by leaching action but through the provision of a more favorable mobility and sweep of the formation. The pregnant lixiviant containing mineral values is produced via the production system and is subsequently subjected to processes for the recovery of the mineral values.

Further advantages of the process of the present invention will be apparent from the following more detailed description thereof.

DESCRIPTION OF THE SPECIFIC EMBODIMENTS

While the present invention is hereinafter described in relation to the in-situ recovery of uranium, it should be understood that the invention is also applicable to the in-situ recovery of inorganic substances capable of reacting with aqueous solubilizers to form solutions miscible with water. These inorganic substances especially include phosphates, iron, aluminum, titanium, copper, nickel, silver, gold, lead, zinc, manganese, cobalt, chromium, and molybdenum. Other substances soluble in aqueous solubilizers will be apparent to those skilled in the art.

The present invention may be carried out utilizing injection and production systems as defined by any suitable arrangement of wells. The injection and production wells can be arranged in any convenient pattern designed to achieve maximum contact of the uranium-containing zones by the leaching fluids, such as the conventional "five spot" pattern wherein a central well is surrounded by four somewhat symmetrically located injection wells. Another of the conventional flooding patterns that can be employed in the practice of this invention is the "line drive" pattern in which the injection wells are arranged in a line so that the injected fluids advance through the formation toward one or more spaced production wells that can also be arranged in a line substantially parallel to the line of injection wells. Other suitable patterns include staggered line drive, four spot, seven spot, circular flood patterns and others.

Uranium minerals frequently occur as a mixture of the insoluble tetravalent form and the soluble hexavalent form. The tetravalent form must be oxidized to its soluble hexavalent form for leaching. Conventionally, the oxidizing agent and the leaching solution are injected simultaneously with the preferred practice being to solubilize the oxidizing agent in the leaching solution. Because of the adverse effects that oxidants have on polymeric thickening agents, it is essential in accordance with the present invention to subject the formation to a pre-oxidation step prior to the injection of the leaching solution, thus minimizing the contact between the oxidants and thickening agents. Although it is preferred that the leaching solution be substantially free of oxidant, this does not preclude the presence of mild oxidants, such as oxygen or air, in minor amounts in the leaching solution. As is known in the art, these oxidants exhibit low solubility in aqueous solutions.

Any of the conventionally used oxidizing agents can be employed as the oxidants in the present invention with preference given to the milder oxidants such as oxygen, air, and oxygen-containing gases. For example, oxygen, air, oxygen-containing gases, or mixtures thereof may be injected into the formation until breakthrough at the production wells, subsequently, the production wells are shut-in to allow oxidation of the formation. This process may be repeated until the desired degree of oxidation has taken place. Alternatively, the above preferred oxidizing gases may be injected into the formation in an aqueous medium. In addition, potassium permanganate, potassium ferricyanide, sodium hypochlorite, potassium peroxydisulfate, and hydrogen peroxide can be employed as oxidants. Oxygen and oxygen-containing gases are the preferred oxidants. These include air, $CO_2/O_2$, and oxygen/steam systems.

After the oxidation of the formation is completed, an aqueous leaching solution or lixiviant is injected into the formation to solubilize the uranium therein. As is well known in the art, the lixiviant may be an acidic or alkaline medium which solubilizes uranium values as it traverses the ore body. For example, carbonate leaching systems employing alkali metal carbonates and/or bicarbonates are suitable leaching solutions for application in the present invention. Additionally, systems utilizing carbon dioxide as the leaching agent may be applied in accordance with the present invention. The above represent examples of leaching solutions and are not intended to be limiting. Other leaching solutions may be utilized depending on the thickening agent used.

In many ore deposits the strata are sufficiently heterogeneous as to severely alter flow patterns of the leaching solution. Leaching fluids follow the higher permeability streaks thus by-passing portions of the ore body. Tests show that in many reservoirs 30 to 50% or more of uranium ore values may not be recoverable via in-situ leaching because of channeling of leachate through the high permeability zones. This is especially true in a formation having a low permeability matrix which has been extensively fractured or which has high permeability streaks running through the basic formation matrix. In such a situation, the fractures or streaks have a permeability which is quite high and is drastically different from the unfractured or base matrix.

While the uranium flooding process of this invention is particularly adopted for the improving the recovery of uranium from heterogeneous formations, as a practical matter, most uranium formations exhibit some heterogeneity, and thus recoveries are improved in most naturally-occuring uranium formations by treatment with the processes of this invention. By heterogeneity, it is meant that the formation is comprised of stratified layers of varying permeability, or that it contains fractures, cracks, fissures, streaks, vuggs, or zones of varying permeability that cause injected fluids to advance through the formation nonuniformly. Thus, the formations that are particularly amenable to treatment by the process of this invention are those formations that have strata or zones of different permeabilities, or which otherwise are structurally faulted so that the injected leaching fluid does not advance through the formation at a substantially uniform rate.

Several techniques, involving the use of thickening agents, are proposed in order to improve the sweep efficiency of the injected uranium leaching medium and thus avoid premature breakthrough at one more of the wells comprising the production system. While various thickening agents can be used, the discussion below will refer to polymers since polymers are the most commonly used thickening agents. The polymer solution used for mobility control is a water solution of a water-soluble polymer especially selected for its ability to reduce fluid mobility in the more permeable zones without causing substantial complete plugging or stoppage of flow within these zones. Hence the polymer must not exhibit any substantial chemical reaction with the formation rock, the connate formation fluids, or the leaching solution, that would cause cross-linking or precipitation of the polymer, or that would result in any substantial amount of absorption of the polymer by the reservoir rock causing complete plugging of any particular strata or zone. The type of polymer employed for mobility adjustment, its concentration in the aqueous polymer solution, and the amount of polymer solution injected into the reservoir are selected upon consideration of the permeability of the formation to the injected fluids, the differences in permeability between the various zones, and the reservoir volume to be treated. The reservoir structure can be predicted from core analysis, well logs, and the history of previous fluid injection programs where applicable. The optimum mobility control can be verified by conventional laboratory core tests. Typically, mobility control can be achieved in most reservoirs by the injection of between about 0.005 and 0.15 pore volume of an aqueous polymer solution containing between about 0.01 and 0.20 weight percent polymer.

Various thickening agents which may be employed in carrying out the present invention include such natural materials as guar gum or karaya gum or such synthetic products as the ionic polysaccharide B-1459 produced by fermentation of glucose with the bacterium xanthomonas campestris NRRL B-1459, USDA, and available from the Kelco Chemical Company under the trade name "Kelzan"; and poly(glucosylglucan)s such as disclosed in U.S. Pat. No. 3,372,749 to Williams and available from the Pillsbury Company under the trade name "Polytran." Other thickening agents which may be employed include carboxymethyl cellulose, polyethyleneoxide, hydroxyethyl cellulose, and the partially hydrolized polyacrylamides available from the Dow Chemical Company under the trade name of "Pusher Chemicals." While the above are specific examples, it is understood that any thickening agent compatable with the formation involved may be employed in the invention.

There are several means in which sweep efficiency of a leaching solution can be improved through the utilization of a mobility control aqueous solution that contains a thickening agent. In one aspect of the invention, the formation is subjected to a preoxidation step as described above. Subsequently, an aqueous solution containing a leaching agent is introduced into the subterranean uranium-containing formation through a suitable injection system. Since economics severely limit the total quantity of leaching solution that can be injected, it is beneficial to displace the leaching solution with a much less expensive fluid. The viscosity of the fluid utilized to drive the leaching solution through the formation should be greater than the viscosity of the leaching solution in order to eliminate unwarranted fingering effects. This is achieved by displacing the leaching fluid with water containing a thickening agent, thus providing the necessary mobility reduction through increase in viscosity. The leaching solution may be an acidic or alkaline solution which solubilizes uranium values as it traverses the ore body. The pregnant lixiviant is then withdrawn from the ore body through a production system and treated to recover uranium therefrom by suitable techniques such as solvent extraction, direct precipitation or by absorption and elution employing an ion exchange resin. The above process may be repeated if necessary.

Since the majority of formations do not have a substantially uniform matrix, channeling of the lixiviant occurs, thus by-passing regions of the ore. The foregoing disadvantage can be eliminated by using a thickened aqueous solution of a water soluble thickening agent. Prior to the injection of the leaching solution or after the first slug of leaching solution, a thickened aqueous solution is introduced into the formation. The thickened aqueous solution will traverse the formation by flowing through the higher permeability zones. When a sufficient amount of the thickened solution is introduced to occupy the higher permeability zones, additional leaching solution is introduced which will traverse the previously unswept or the lower permeability zones thus solubilizing more uranium. This result is accomplished because of the substantial reduction in mobility in the higher permeability zones due to the presence of more viscous fluids. After the production cycle, additional cycles or slugs of thickened solution and leaching solution can be utilized until such operations become uneconomical.

An alternate form of the invention is to inject with the leaching solution a thickener of the type that exhibits an increase in viscosity with increasing shear rate. The advantage gained here is that the viscosity increases in the naturally occuring paths of higher flow because of the higher shear rate. The increased viscosity thus creates a higher pressure drop resulting in less flow in this region. The leaching solution is then diverted to the regions of lower permeability heretofore by-passed, thus, resulting in the solubilization of more uranium. Some examples of materials which exhibit an increase in viscosity with increasing shear rate include various starch suspensions, heavy metal phosphates, sodium borate, and polyvinyl alcohols.

The viscosity of the aqueous mobility control medium should normally be the viscosity of the leaching solution and the reservoir fluids. The viscosity of the mobility control medium may be within the range of 1 to 4 times that of the leaching solution and the reservoir rock with the upper limit being due to economic constraints. The desired viscosities are usually achieved by using up to 3 weight percent of a thickener. As will be understood by those skilled in the art, the viscosity of the thickener solution as referred to herein is the viscosity at shear rates and at temperature conditions prevailing throughout most of the formation volume traversed by the mobility control medium as it travels between the injection and production systems.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. An improved process for the in-situ recovery of mineral values from a mineral-bearing subterranean formation having heterogeneous permeability zones and penetrated by injection and production systems, comprising:

(a) injecting into the formation an oxidant to oxidize the mineral values therein;

(b) introducing into the formation via the injection system an aqueous leaching solution, which is substantially free of oxidant, to solubilize the mineral values therein;

(c) displacing the leaching solution through the subterranean formation by means of a mobility control aqueous solution comprising a sufficient amount of thickening agent to give the mobility control solution a greater viscosity than that of the leaching solution;

(d) producing pregnant leachate containing mineral values via the production system; and (e) recovering mineral values from the pregnant leachate.

2. The method wherein the process of claim 1 is repeated in cycles.

3. The process of claim 1 wherein the thickening agent comprises a high molecular weight polymer.

4. The process of claim 1 as applied to the in-situ recovery of uranium.

5. The process of claim 4 wherein the oxidant is selected from the group comprising oxygen, oxygen-containing gas, air, or mixtures thereof.

6. The process of claim 5 wherein the oxidants are injected into the formation in an aqueous medium.

7. The process of claim 1 wherein the oxidant is injected into the formation until the oxidant has broken through the production system, at which point the production wells are shut-in to permit oxidation of the formation.

8. The process of claim 7 wherein the oxidation step is repeated.

9. The process of claim 4 wherein the aqueous leaching solution comprises carbon dioxide.

10. The process of claim 4 wherein the aqueous leaching solution comprises carbonates, bicarbonates or mixtures thereof.

11. An improved process for the in-situ recovery of mineral values from a mineral-bearing subterranean formation having heterogeneous permeability zones and penetrated by injection and production systems, comprising:

(a) injecting into the formation an oxidant to oxidize the mineral values therein;

(b) introducing into the formation via the injection system an aqueous solution containing a thickening agent;

(c) introducing into the formation via the injection system a lixiviant containing a leaching agent and being substantially free of oxidant;

(d) displacing the lixiviant through the subterranean formation to solubilize mineral values therein;

(e) producing pregnant lixiviant containing the leached mineral values via the production system; and (f) treating the pregnant lixiviant to recover mineral values therefrom;

wherein the aqueous solution of step (b) contains a sufficient amount of thickening agent to give it a greater viscosity than that of the lixiviant of step (c).

12. The method wherein the process of claim 11 is repeated in cycles.

13. The process of claim 11 wherein the mineral value is uranium.

14. The process of claim 11 wherein the formation is initially subjected to a conventional in-situ leaching operation prior to step (a).

15. The process of claim 11 wherein the thickening agent comprises a high molecular weight polymer.

16. The process of claim 11 wherein the mobility ratio of the lixiviant in step (c) is greater than 1 but less than 4 times that of the aqueous solution of step (b).

17. The process of claim 13 wherein the oxidant is selected from the group comprising oxygen, oxygen-containing gas, air, or mixtures thereof.

18. The process of claim 17 wherein the oxidants are injected into the formation in an aqueous medium.

19. The process of claim 11 wherein the oxidant is injected into the formation until the oxidant has broken through the production system at which point the production wells are shut-in to permit oxidation of the formation.

20. The process of claim 19 wherein the oxidation step is repeated.

21. The process of claim 13 wherein the aqueous leaching solution comprises carbon dioxide.

22. The process of claim 13 wherein the aqueous leaching solution comprises carbonates, bicarbonates or mixtures thereof.

23. An improved process for the in-situ recovery of mineral values from a mineral-bearing subterranean formation having heterogeneous permeability zones and penetrated by injection and production systems, comprising:

(a) injecting into the formation an oxidant to oxidize the mineral values therein;

(b) injecting into the formation via the injection system a lixiviant containing a leaching agent and a thickening agent and being substantially free of oxidant;

(c) displacing the lixiviant through the subterranean formation to solubilize the mineral values therein;

(d) producing pregnant lixiviant containing mineral values via the production system; and (e) treating the pregnant lixiviant to recover mineral values therefrom.

24. The process of claim 23 wherein the concentration of the thickening agent in the lixiviant is from 0.01 to 3 wt.%.

25. The process of claim 23 wherein the thickening agent belongs to the group of thickening agents that exhibit an increase in viscosity with increasing shear rate.

26. The method wherein the process of claim 23 is repeated in cycles.

27. The process of claim 23 wherein the thickening agent comprises a high molecular weight polymer.

28. The process of claim 23 wherein the mineral value is uranium.

29. The process of claim 28 wherein the oxidant is selected from the group comprising oxygen, oxygen-containing gas, air, or mixtures thereof.

30. The process of claim 29 wherein the oxidants are injected into the formation in an aqueous medium.

31. The process of claim 23 wherein the oxidant is injected into the formation until the oxidant has broken through the production system at which point the production wells are shut-in to allow oxidation of the formation.

32. The process of claim 31 wherein the oxidation step is repeated.

33. The process of claim 23 wherein the leaching agent is carbon dioxide.

34. The process of claim 23 wherein the leaching agent comprises carbonates, bicarbonates, or mixtures thereof.

* * * * *